US011788544B2

(12) United States Patent
Sun et al.

(10) Patent No.: US 11,788,544 B2
(45) Date of Patent: Oct. 17, 2023

(54) CENTRIFUGAL-TO-AXIAL MIXED FLOW BLOWER AND HEAT DISSIPATION SYSTEM USING SAME

(71) Applicant: ASIA VITAL COMPONENTS CO., LTD., New Taipei (TW)

(72) Inventors: Sung-Wei Sun, New Taipei (TW); Jing-Ping Huang, New Taipei (TW); Zizhuo Li, New Taipei (TW); Feng Liu, New Taipei (TW)

(73) Assignee: ASIA VITAL COMPONENTS CO., LTD., New Taipei (TW)

( * ) Notice: Subject to any disclaimer, the term of this patent is extended or adjusted under 35 U.S.C. 154(b) by 0 days.

(21) Appl. No.: 17/959,317

(22) Filed: Oct. 4, 2022

(65) Prior Publication Data

US 2023/0265859 A1 Aug. 24, 2023

(30) Foreign Application Priority Data

Feb. 18, 2022 (TW) ..... 111106063

(51) Int. Cl.
*F04D 29/28* (2006.01)
*F04D 29/44* (2006.01)

(52) U.S. Cl.
CPC ..... *F04D 29/281* (2013.01); *F04D 29/441* (2013.01)

(58) Field of Classification Search
CPC ..... F04D 29/281; F04D 29/441
See application file for complete search history.

(56) References Cited

U.S. PATENT DOCUMENTS 6,457,955 B1 * 10/2002 Cheng ..... F04D 25/066 165/122
8,636,479 B2 * 1/2014 Kenyon ..... H02K 1/185 417/423.5

(Continued)

FOREIGN PATENT DOCUMENTS

CN 102072174 A 5/2011
TW I263735 B 10/2006

(Continued)

OTHER PUBLICATIONS

Search Report dated Aug. 30, 2022 issued by Taiwan Intellectual Property Office for counterpart application No. 111106063.

*Primary Examiner* — Sabbir Hasan
(74) *Attorney, Agent, or Firm* — Demian K. Jackson; Jackson IPG PLLC

(57) ABSTRACT

A centrifugal-to-axial mixed flow blower includes a blower enclosure defining a blower chamber and a centrifugal impeller supported on an impeller seat to suspend in the blower chamber. The centrifugal impeller includes a plurality of blades and a radially outward declined flow passage defined between any two adjacent blades and communicable with the blower chamber. The blower chamber is communicable with a rectangular air outlet of a heat dissipation system via a frame passage of a flow guide frame connected to below the blower enclosure. Air stream centrifugally drawn in by the centrifugal impeller passes through the declined flow passages to radially outward and downward flow into the blower chamber and then passes through the frame passage to flow axially through the rectangular air outlet into the heat dissipation system, so as to realize the effects of reduced noise, changing centrifugal vortical flow into axial flow, and decreased flow loss.

12 Claims, 15 Drawing Sheets

(56) References Cited

U.S. PATENT DOCUMENTS

| | | | | |
|---|---|---|---|---|
| 2006/0051221 | A1* | 3/2006 | Chen | F04D 29/329<br>417/423.1 |
| 2019/0353177 | A1* | 11/2019 | Chang | F04D 29/056 |

FOREIGN PATENT DOCUMENTS

| | | | |
|---|---|---|---|
| TW | M403011 | U | 5/2011 |
| TW | I602998 | B | 10/2017 |
| TW | M628272 | U | 6/2022 |

* cited by examiner

B

CENTRIFUGAL-TO-AXIAL MIXED FLOW BLOWER AND HEAT DISSIPATION SYSTEM USING SAME

This application claims the priority benefit of Taiwan patent application number 111106063 filed on Feb. 18, 2022.

FIELD OF THE INVENTION

The present invention relates to the field of heat dissipation by blower, and more particularly, to a centrifugal-to-axial mixed flow blower and a heat dissipation system using same.

BACKGROUND OF THE INVENTION

A blower is one type of turbomachinery that converts mechanical energy into fluid's kinetic energy, so as to overcome pipeline resistance and energy loss and convey a fluid to a specific location. The blower can be generally divided into three types, namely, axial flow blower, centrifugal flow blower, and cross flow blower. In the case of an axial flow blower, air is drawn in and blown out of the blower in an axial direction of an axial impeller of the blower; since the air flows into the blower from upper edges of blades of the axial impeller and flows out of the blower from lower edges of the blades of the axial impeller, an area located directly behind a hub of the axial impeller forms a dead zone without any air flowing therethrough. In the case of a centrifugal flow blower, it operates in a principle the same as that of a centrifugal pump. That is, air flows in an axial direction of a centrifugal impeller to pass through an air inlet of a volute into the centrifugal impeller. Under a centrifugal effect generated by the operating centrifugal impeller, the air then flows in a direction tangential to the rotation direction of the centrifugal impeller to move from an outer peripheral edge of the centrifugal impeller into a spiral chamber in the volute, from where the air is discharged via an air outlet of the volute.

For different system spaces, different types of blowers are used. For example, for a relatively large cabinet space, the axial flow blower is used. On the other hand, in most conditions, the centrifugal flow blower is suitable for use in a narrow and flat space.

As shown in FIGS. 4A to 4C, a heat dissipation system enclosure 51 includes a receiving recess 511 and a system internal space 512. The receiving recess 511 includes a bottom 5111, which separates the receiving recess 511 from the system internal space 512. The bottom 5111 of the receiving recess 511 is formed with a narrow rectangular air outlet 513, which is communicable with the receiving recess 511 and the system internal space 512. An axial flow blower 52 is disposed in the receiving recess 511 and has an overall dimension, for example, 60 mm×60 mm×25 mm, larger than that of the narrow rectangular air outlet 513, for example, 90 mm×20 mm. Thus, an axial impeller 521 of the axial flow blower 52 has only a small portion that is located corresponding to the narrow rectangular air outlet 513. In other words, a large portion of the axial impeller 521 is located corresponding to the bottom 5111 of the receiving recess 511.

The axial impeller 521 includes a hub 5211 and a plurality of blades 5212 spaced on and around the hub 5211. When the axial impeller 521 of the axial flow blower 52 rotates, no air flows to a blind zone or dead zone that is located directly behind the hub 5211 to drive the air through the narrow rectangular air outlet 513. Most of the air flowing through lower edges of the blades 5212 is blocked by the bottom 5111 of the receiving recess 511 instead of passing through the narrow rectangular air outlet 513. The blocked air flows reversely toward the axial blower 52 to collide with air that continuously flows from the axial impeller 521 to therefore generate turbulent air flows, which prevent most part of the air flows from flowing into the system internal space 512 via the narrow rectangular air outlet 513.

In the case a cross flow blower is used in place of the axial blower 52 and disposed in direct correspondence to the narrow rectangular air outlet 513 in order to get an increased air-outlet area share, a relatively loud noise would be produced because air flows into and out of a cross flow fan in the cross flow blower in a radial direction with respect to the cross flow fan.

It is therefore tried by the inventor to solve the above-mentioned problems.

SUMMARY OF THE INVENTION

To improve the above problems, a primary object of the present invention is to provide a centrifugal-to-axial mixed flow blower and a heat dissipation system using same. The centrifugal-to-axial mixed flow blower can be used in a narrow space in the system for an air stream to flow through an air outlet of the system in an axial direction without producing loud noise.

Another object of the present invention is to provide a centrifugal-to-axial mixed flow blower and a heat dissipation system using same, so as to realize the effect of changing a centrifugal vortical flow into an axial flow.

A further object of the present invention is to provide a centrifugal-to-axial mixed flow blower, which includes a declined flow passage between any two adjacent blades of a centrifugal impeller, so that air is guided by the declined flow passages to flow radially outward and downward from the centrifugal impeller into a blower chamber. With the declined flow passages, it is able to realize the effect of decreasing flow loss caused by change in the flow direction of air.

To achieve the above and other objects, the centrifugal-to-axial mixed flow blower of the present invention is suitable for use with a heat dissipation system container having a rectangular air outlet. The centrifugal-to-axial mixed flow blower includes a blower enclosure, an impeller seat, and a centrifugal impeller. The blower enclosure includes a main body and a flow guide frame. The main body has an air-in side and an opposite air-out side, which together define a blower chamber between them. The flow guide frame is located at the air-out side of the main body and adjacent to the rectangular air outlet of the system container, and includes a butt joining side, an outlet side, and an air guide surface. The butt joining side and the outlet side are located at two opposite sides of the flow guide frame, and the air guide surface is formed on an inner side of the flow guide frame to extend slantly from the butt joining side to the air-out side and define a frame passage on the flow guide frame; and the frame passage is communicable with the blower chamber and the rectangular air outlet. The impeller seat includes a seat portion and two cantilever portions. The cantilever portions are extended radially outward from an outer periphery of the seat portion and respectively have a distal end formed into a corresponding connecting section for connecting to the main body of the blower enclosure, such that the impeller seat is supported in the blower chamber and the frame passage. The centrifugal impeller is mounted on the seat portion of the impeller seat and located below the air inlet of the blower enclosure. The centrifugal impeller includes a top impeller frame, a bottom impeller frame, and a plurality of blades located between the top and the bottom impeller frame. A radially outward declined flow passage is defined between any two adjacent blades, and the declined flow passages are respectively declined from a center toward an outer peripheral edge of the centrifugal impeller and communicable with the blower chamber. Air drawn in by the centrifugal impeller is guided by the declined flow passages to flow into the blower chamber in radially downward and outward directions and then pass through the frame passage, at where the air is guided by the air guide surface to the rectangular air outlet to flow into the system container.

To achieve the above and other objects, the present invention also provides a heat dissipation system using centrifugal-to-axial mixed flow blower. The heat dissipation system includes a system container and a centrifugal-to-axial mixed flow blower. The system container includes a receiving recess and a container space. The receiving recess includes a bottom that separates the receiving recess from the container space, and a partial area of the bottom is formed into a substantially rectangular air outlet, which is communicable with the container space. The container space has a heat dissipation unit disposed therein to be located below the receiving recess. The centrifugal-to-axial mixed flow blower includes a blower enclosure, an impeller seat, and a centrifugal impeller. The blower enclosure includes a main body and a flow guide frame. The main body has an air-in side and an opposite air-out side, which together define a blower chamber between them. The flow guide frame is located at the air-out side of the main body and adjacent to the rectangular air outlet of the system container, and includes a butt joining side, an outlet side, and an air guide surface. The butt joining side and the outlet side are located at two opposite sides of the flow guide frame, and the air guide surface is formed on an inner side of the flow guide frame to extend slantly from the butt joining side to the air-out side and define a frame passage on the flow guide frame; and the frame passage is communicable with the blower chamber and the rectangular air outlet. The impeller seat includes a seat portion and two cantilever portions. The cantilever portions are extended radially outward from an outer periphery of the seat portion and respectively have a distal end formed into a corresponding connecting section for connecting to the main body of the blower enclosure, such that the impeller seat is supported in the blower chamber and the frame passage. The centrifugal impeller is mounted on the seat portion of the impeller seat and located below the air inlet of the blower enclosure. The centrifugal impeller includes a top impeller frame, a bottom impeller frame, and a plurality of blades located between the top and the bottom impeller frame. A radially outward declined flow passage is defined between any two adjacent blades, and the declined flow passages are respectively declined from a center toward an outer peripheral edge of the centrifugal impeller and communicable with the blower chamber. Air drawn in by the centrifugal impeller is guided by the declined flow passages to flow into the blower chamber in radially downward and outward directions and then pass through the frame passage, at where the air is guided by the air guide surface to the rectangular air outlet to flow into the system container.

In the present invention, the frame passage is tapered from the butt joining side toward the outlet side to extend through a thickness direction of the flow guide frame; the butt joining side is connected to the air-out side of the main body of the blower enclosure; and the air guide surface is a slanted surface or a concave surface.

In the present invention, the main body of the blower enclosure includes a top wall located at the air-in side and formed with an air inlet and two connecting sections. The air inlet is communicable with the blower chamber, and the two connecting sections are connected to the corresponding connecting sections of the impeller seat.

In the present invention, the top impeller frame is located above the blades and is radially outward declined from a center toward the outer peripheral edge of the centrifugal impeller to define a flow intake, which is located corresponding to the air inlet of the blower enclosure; and the bottom impeller frame includes a radially outward slanted surface, on which the blades are located. The slanted surface of the bottom impeller frame is radially outward declined from an outer side of the hub toward the outer peripheral edge of the centrifugal impeller, and the slanted surface of the bottom impeller frame and the slanted top impeller frame together define the declined flow passages.

In the present invention, an area of the top wall of the blower enclosure located around a rim of the air inlet is a bent section, which is bent toward the blower chamber to define an annular groove in the blower chamber; and the flow intake of the top impeller frame has a circumferential edge, which is upward protruded toward the top wall to form an upward protruded ring, and the upward protruded ring is correspondingly located in the annular groove of the top wall.

In the present invention, an outer cover covers the air-in side of the blower enclosure and includes an air venting mesh portion, which has a plurality of through holes distributed thereon and is located corresponding to the air inlet at the air-in side of the blower enclosure; and a frame-shaped gasket is provided between the flow guide frame and the bottom of the receiving recess.

BRIEF DESCRIPTION OF THE DRAWINGS

The structure and the technical means adopted by the present invention to achieve the above and other objects can be best understood by referring to the following detailed description of the preferred embodiment and the accompanying drawings, wherein.

DETAILED DESCRIPTION OF THE PREFERRED EMBODIMENTS

The present invention will now be described with a preferred embodiment thereof.

Figure 1A:
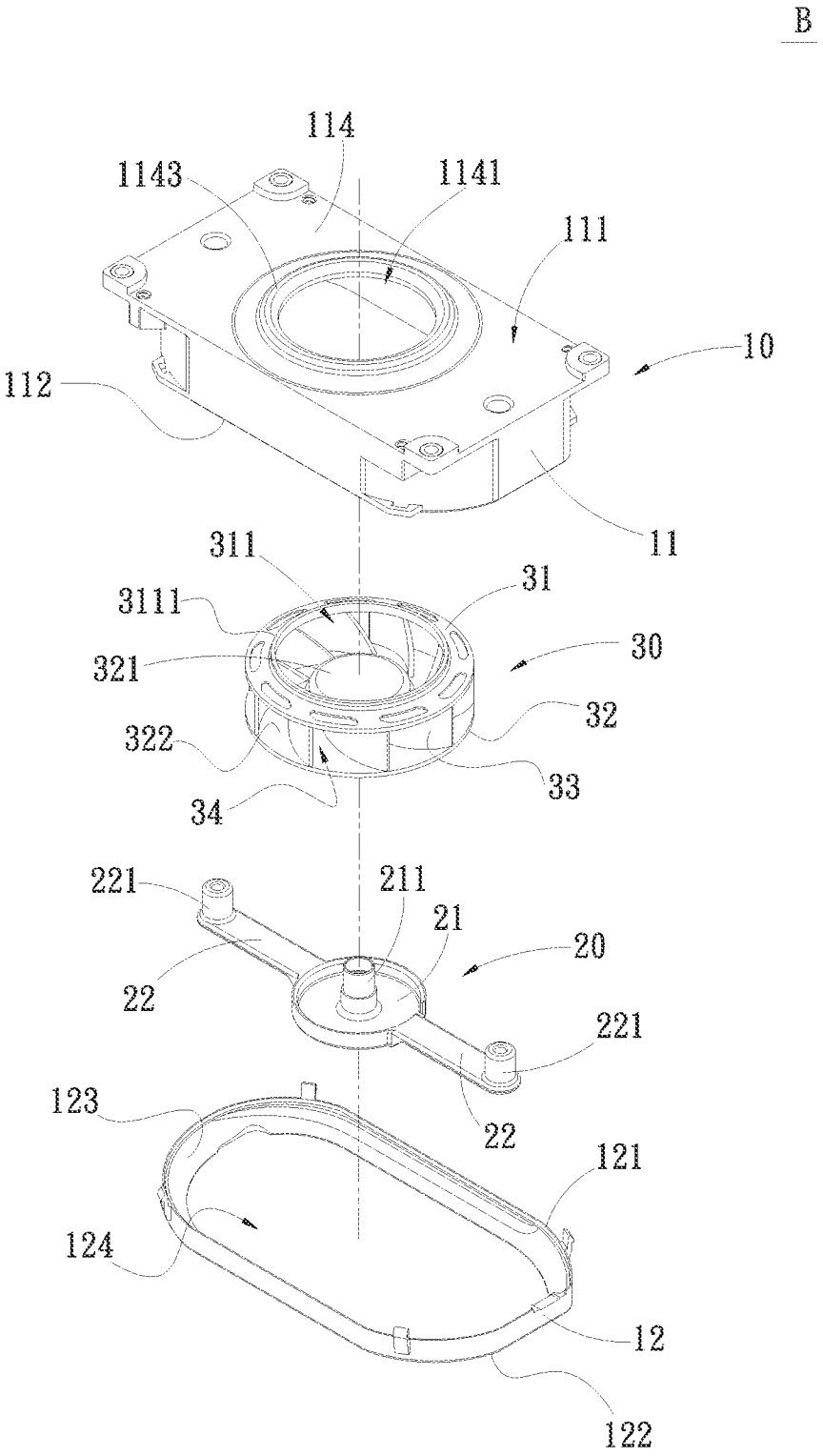
FIG. 1A is an exploded perspective view of a centrifugal-to-axial mixed flow blower according to a preferred embodiment of the present invention.
Figure 1B:
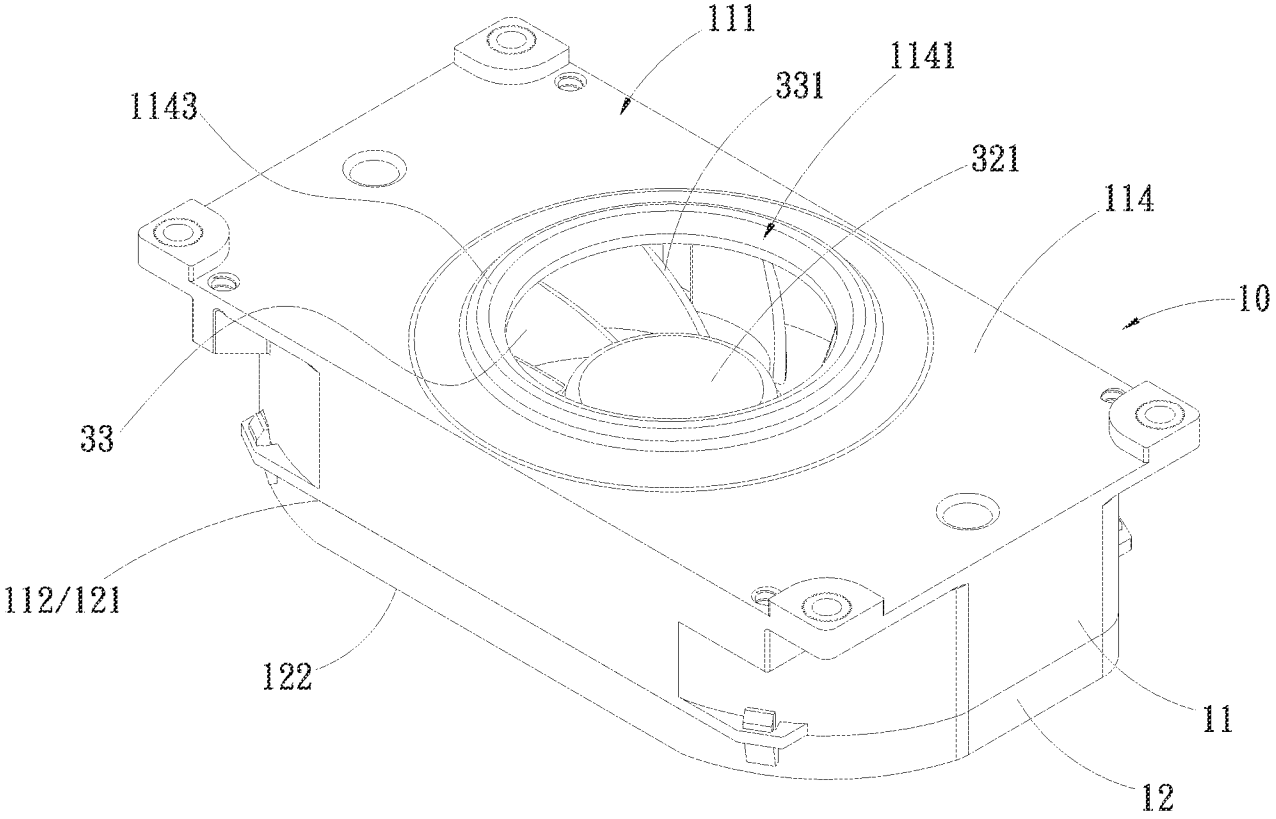
FIG. 1B is an assembled view of FIG. 1A.
Figure 1C:
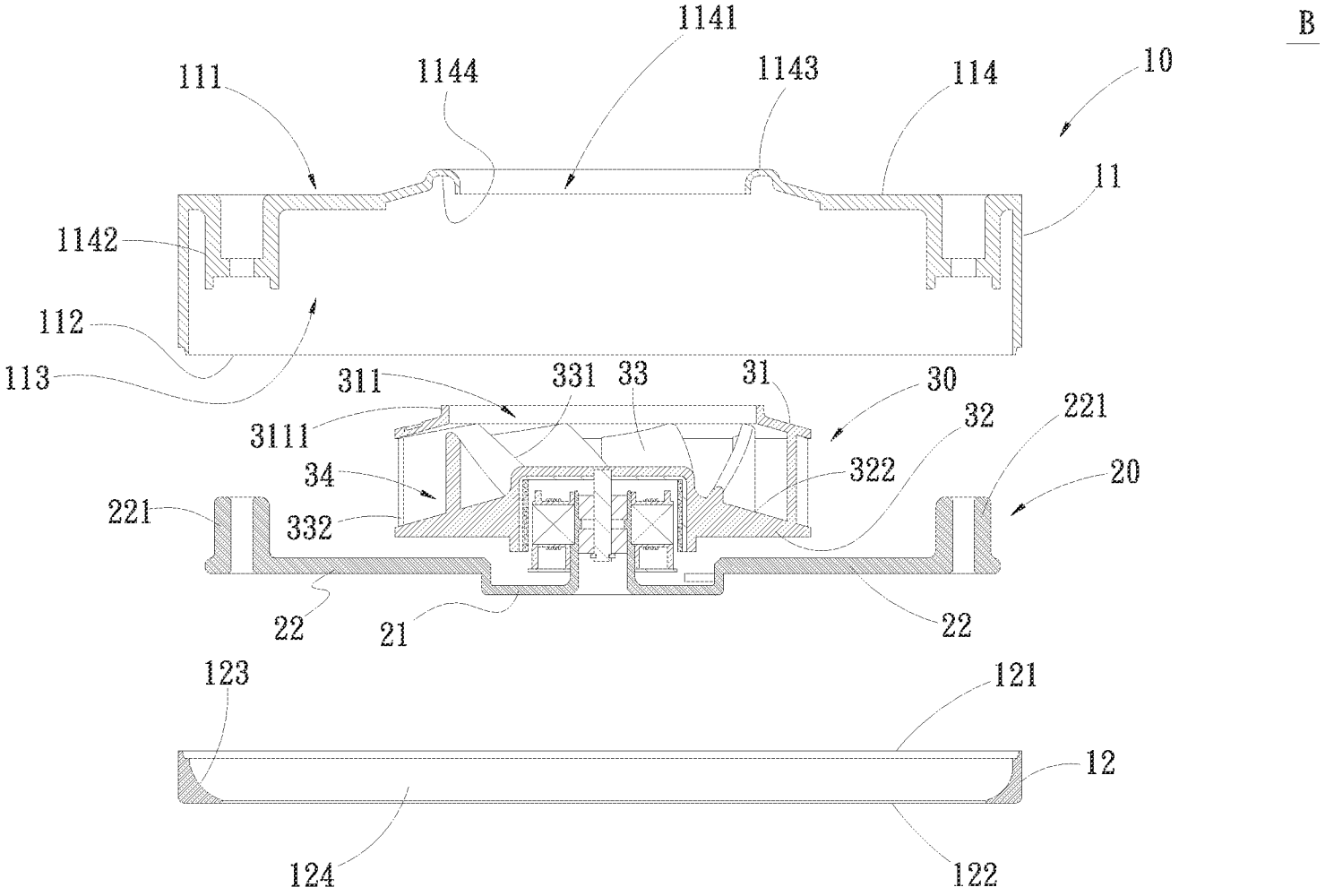
FIG. 1C is an exploded sectional view of the centrifugal-to-axial mixed flow blower according to the preferred embodiment of the present invention.
Figure 1D:
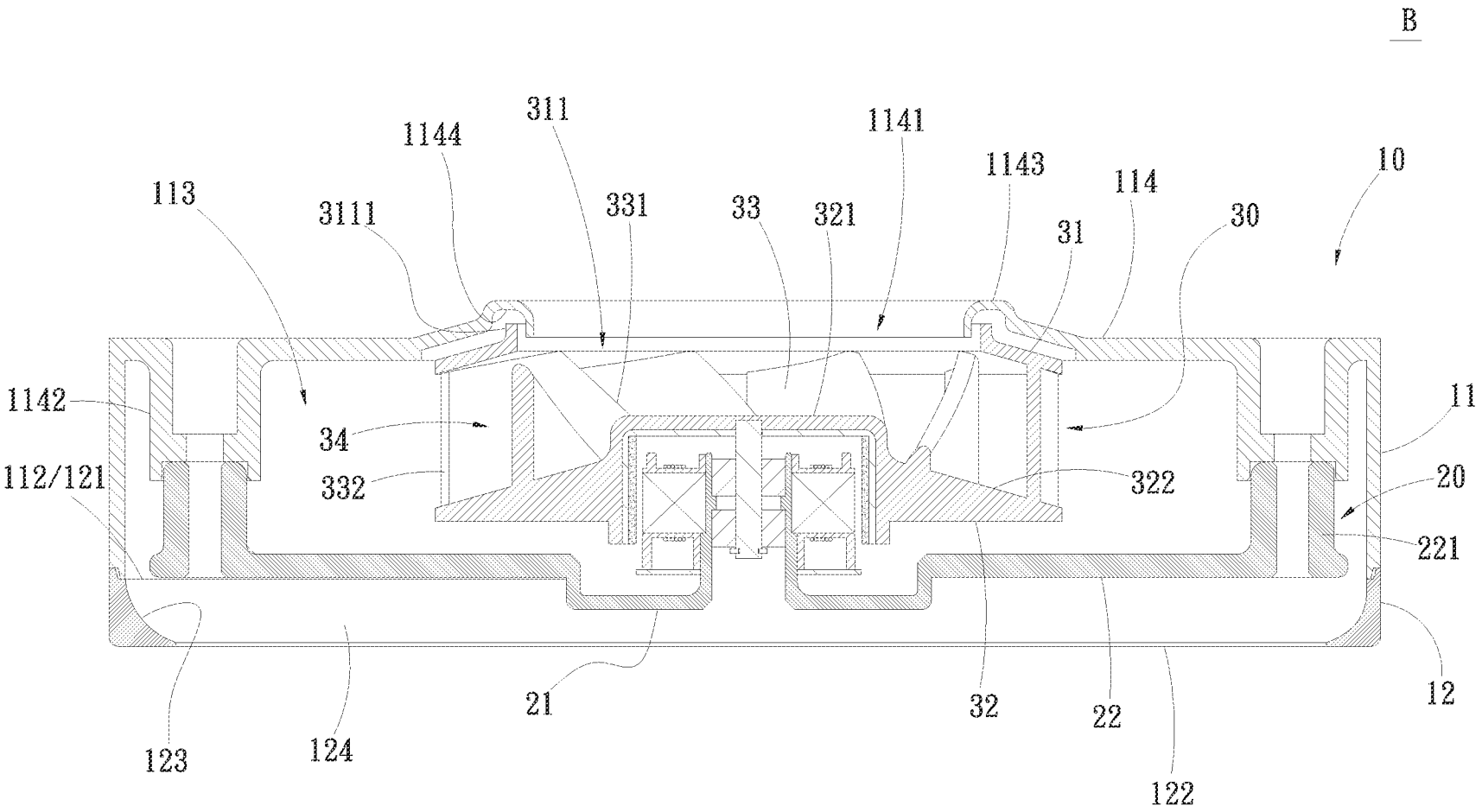
FIG. 1D is an assembled view of FIG. 1C.

Please refer to FIGS. 1A and 1B, which are exploded and assembled perspective views, respectively, of a centrifugal-to-axial mixed flow blower B according to a preferred embodiment of the present invention; and to FIGS. 1C and 1D, which are exploded and assembled sectional views, respectively, of the centrifugal-to-axial mixed flow blower B of FIGS. 1A and 1B. As shown, the centrifugal-to-axial mixed flow blower B includes a blower enclosure 10, an impeller seat 20, and a centrifugal impeller 30. The impeller seat 20 and the centrifugal impeller 30 are received in the blower enclosure 10. The blower enclosure 10 includes a main body 11 and a flow guide frame 12. The main body 11 has two opposite sides respectively formed into an air-in side 111 and an air-out side 112, which together define a blower chamber 113 in the main body 11. The main body 11 includes a top wall 114 located at the air-in side 111 and formed with an air inlet 1141 and two connecting sections 1142. The air inlet 1141 is located substantially at a central area of the top wall 114 and is communicable with the blower chamber 113. The two connecting sections 1142 are provided at two opposite ends of the main body 11 and spaced from the air inlet 1141. The connecting sections 1142 are in the form of two sunken portions to downward protrude from the top wall 114 into the blower chamber 113. Further, an area of the top wall 114 located around a rim of the air inlet 1141 is a bent section 1143 that is bent toward the blower chamber 113 to define an annular groove 1144 in the blower chamber 113.

The flow guide frame 12 is located at the air-out side 112 of the main body 11 and has a butt joining side 121 for connecting to the air-out side 112 of the main body 11, and an outlet side 122 located opposite to the butt joining side 121. The flow guide frame 12 has an air guide surface 123 formed therein. The air guide surface 123 is a slanted surface or a concave surface extended around an inner side of the flow guide frame 12. More specifically, the surrounding air guide surface 123 has a cross sectional shape slanted or curved downward from the butt joining side 121 into the flow guide frame 12 toward the outlet side 122 to define a frame passage 124 on the flow guide frame 12. The frame passage 124 is communicable with the blower chamber 113, and is tapered from the butt joining side 121 toward the outlet side 122 to extend through a thickness direction of the flow guide frame 12. Thus, the air guide surface 123 functions to guide air flow in the blower chamber 113 to pass through the outlet side 122 axially.

As shown, the impeller seat 20 includes a seat portion 21 and two cantilever portions 22. The cantilever portions 22 are extended radially outward from an outer periphery of the seat portion 21 and respectively have a distal end formed into a corresponding connecting section 221. The corresponding connecting sections 221 can be in the form of, for example, two upward extended barrels for correspondingly connecting to the two connecting sections 1142 downward protruded from the top wall 114 of the main body 11. With these arrangements, the impeller seat 20 is suspended in the blower chamber 113 and the frame passage 124 of the flow guide frame 12. The connecting sections 1142 and the corresponding connecting sections 221 can be connected to one another by different connecting means, such as screws, glue, or snap-fit. The seat portion 21 has a centered upward extended bearing cup 211 for receiving at least one bearing therein. A motor stator, which includes an insulated rack assembly with a silicon steel sheet assembly mounted thereto and a winding wound around the insulated rack assembly and the silicone steel sheet assembly, is fitted around the bearing cup 211. In the illustrated preferred embodiment of the present invention, the impeller seat 20 and the flow guide frame 12 are two separate parts. However, it is understood the present invention is not limited thereto. In other alternative embodiments, the impeller seat 20 and the flow guide frame 12 can be an integrally formed component. For example, the corresponding connecting sections 221 on the two cantilever portions 22 of the impeller seat 20 can be integrally formed with the flow guide frame 12.

Figure 2A:
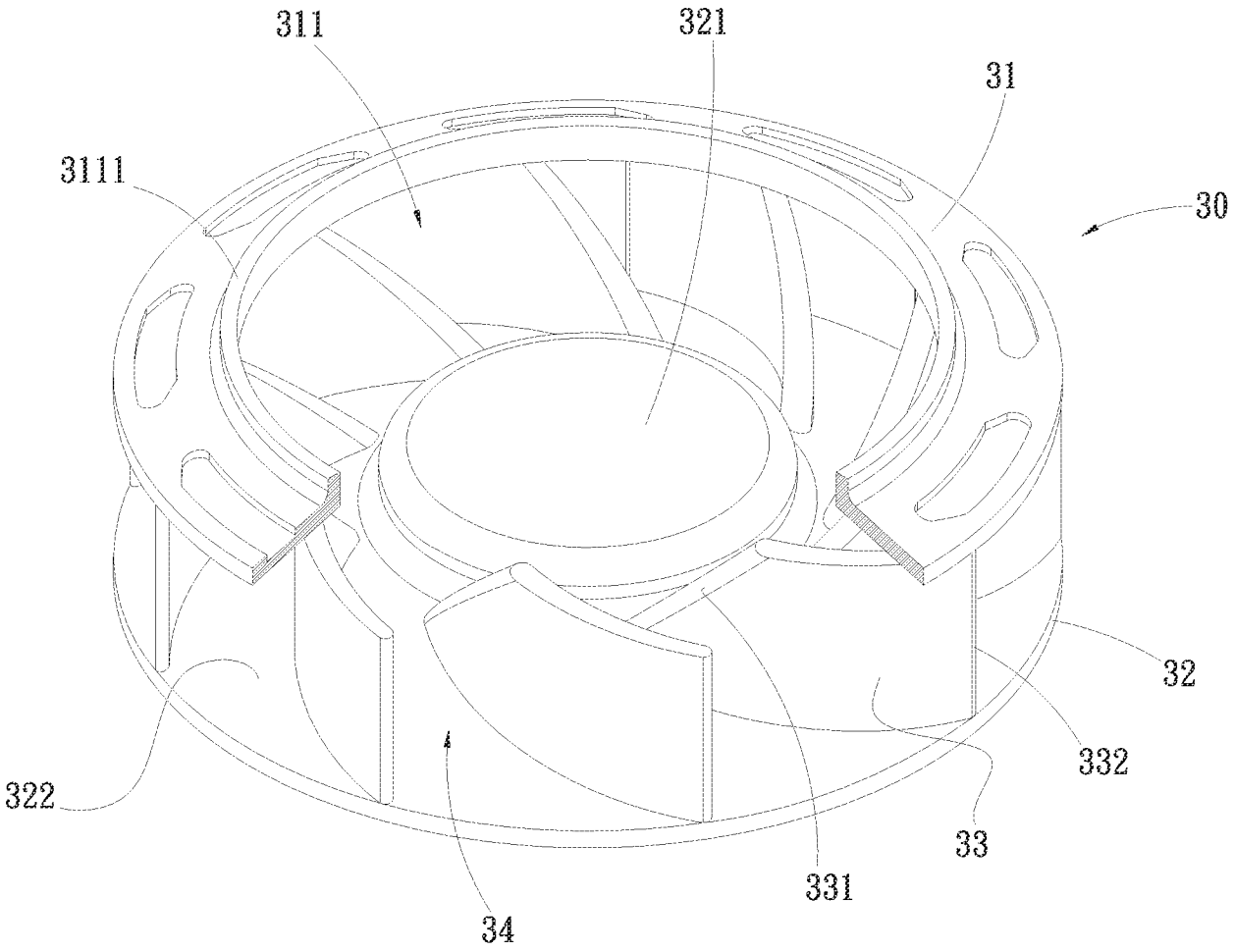
FIG. 2A is a cutaway view of a centrifugal impeller of the centrifugal-to-axial mixed flow blower according to the preferred embodiment of the present invention.
Figure 2B:
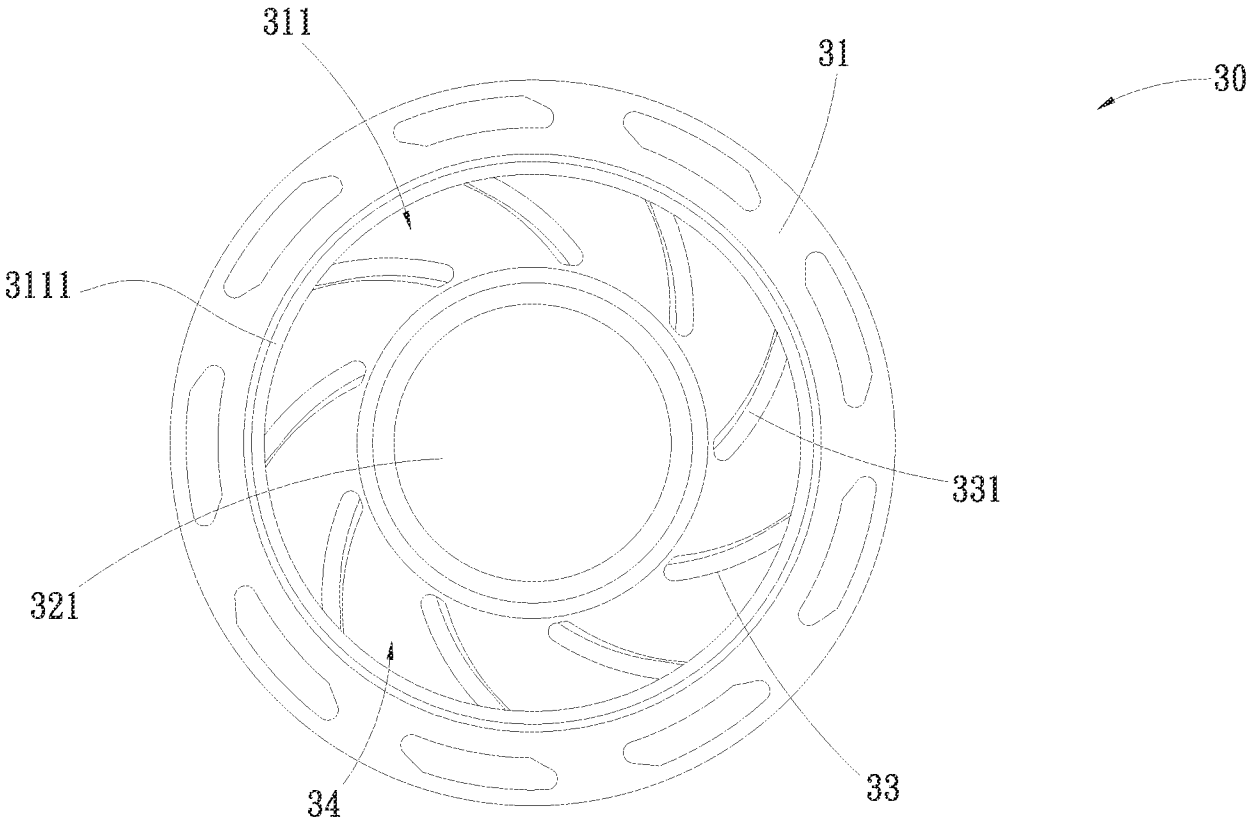
FIG. 2B is a top view of the centrifugal impeller of FIG. 2A.
Figure 2C:
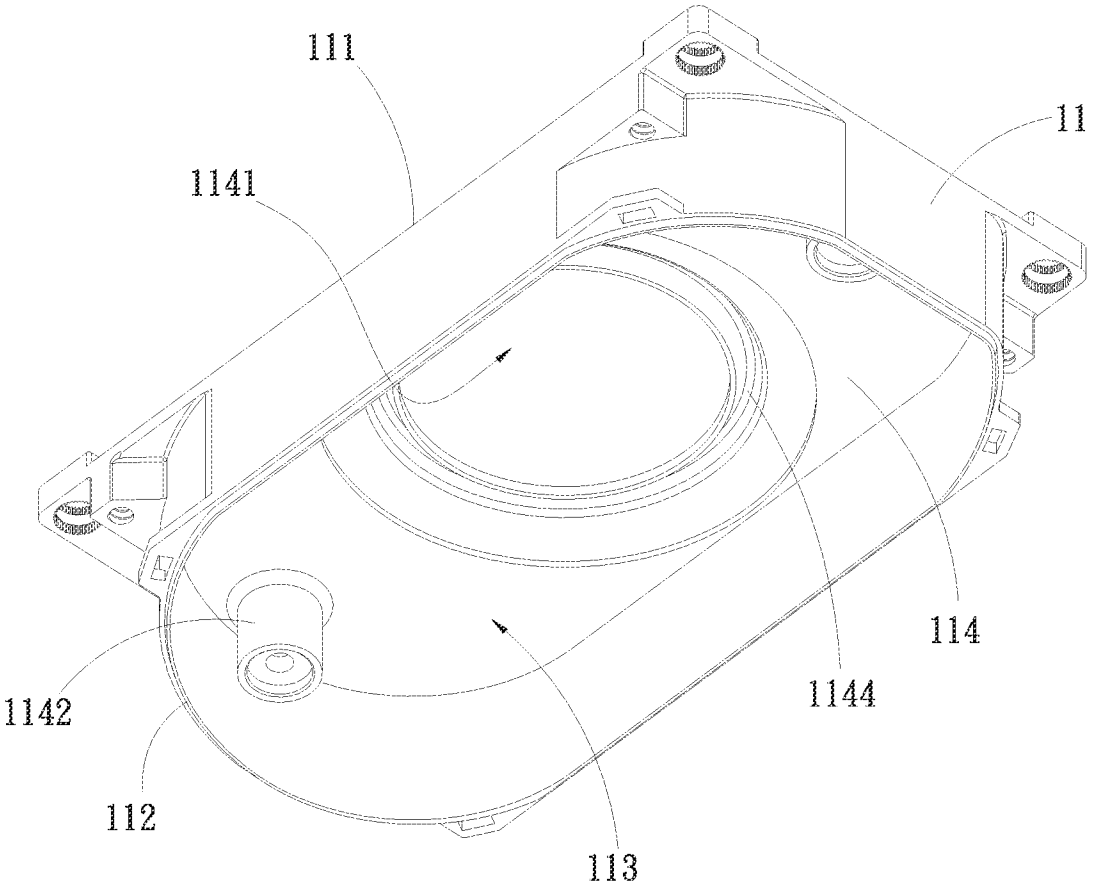
FIG. 2C is a bottom perspective view of a blower enclosure of the centrifugal-to-axial mixed flow blower according to the preferred embodiment of the present invention.

Please refer to FIGS. 2A and 2B, which are cutaway and top views, respectively, of the centrifugal impeller 30. As can be seen from FIGS. 1A to 1D, the centrifugal impeller 30 is mounted on the seat portion 21 of the impeller seat 20 and is located below the air inlet 1141 of the blower enclosure 10. The centrifugal impeller 30 includes a top impeller frame 31, a bottom impeller frame 32, and a plurality of blades 33 located between the top and the bottom impeller frame 31, 32. The top impeller frame 31 is located above the blades 33 and is radially outward declined from a center toward an outer peripheral edge of the centrifugal impeller 30 to define a flow intake 311, which is located corresponding to the air inlet 1141 on the top wall 114 of the blower enclosure 10. The flow intake 311 has a circumferential edge that is upward protruded toward the top wall 114 to form an upward protruded ring 3111, such that the upward protruded ring 3111 of the top impeller frame 31 is located in the annular groove 1144 of the top wall 114 of the blower enclosure 10 to define a winding clearance between the upward protruded ring 3111 and the annular groove 1144, as can be most clearly seen in FIG. 1D. The winding clearance existed between the upward protruded ring 3111 and the annular groove 1144 prevents the air drawn through the air inlet 1141 of the blower enclosure 10 from partially flowing into the blower chamber 113 directly without passing through the centrifugal impeller 30.

The bottom impeller frame 32 includes a hub 321 and a radially outward slanted surface 322. The hub 321 is internally provided with a spindle and a motor rotor with a magnetic ring (not shown). The spindle is inserted into the bearing disposed in the bearing cup 211 on the seat portion 21 of the impeller seat 20 to support the centrifugal impeller 30 on the seat portion 21, and the motor rotor is disposed corresponding to the motor stator fitted around the bearing cup 211. The slanted surface 322 is radially outward declined from an outer side of the hub 321 toward the outer peripheral edge of the centrifugal impeller 30. The blades 33 are formed on the slanted surface and circumferentially spaced around the outer side of the hub 321. The radially outward slanted surface 322 of the bottom impeller frame 32 and the radially outward slanted top impeller frame 31 together define a radially outward declined flow passage 34 between any two adjacent blades 33. The radially outward declined flow passages 34 are declined from the outer side of the hub 321 toward the outer peripheral edge of the centrifugal impeller 30 and are communicable with the blower chamber 113. Therefore, the air flowing into the centrifugal impeller 30 is guided by the declined flow passages 34 to flow into the blower chamber 113 in radially downward and outward directions.

Each of the blades 33 has an air-in edge 331 located adjacent to the hub 321, and an air-out edge 332 located at the outer peripheral edge of the centrifugal impeller 30. The air-in edge 331 is downward inclined from the top impeller frame 31 toward the bottom impeller frame 32 and is located corresponding to the flow intake 311, so that the air drawn through the air inlet 1141 of the blower enclosure 10 is guided by the air-in edges 331 of the blades 33 to smoothly flow into the declined flow passages 34 to enable an increased intake air amount.

Figure 3A:
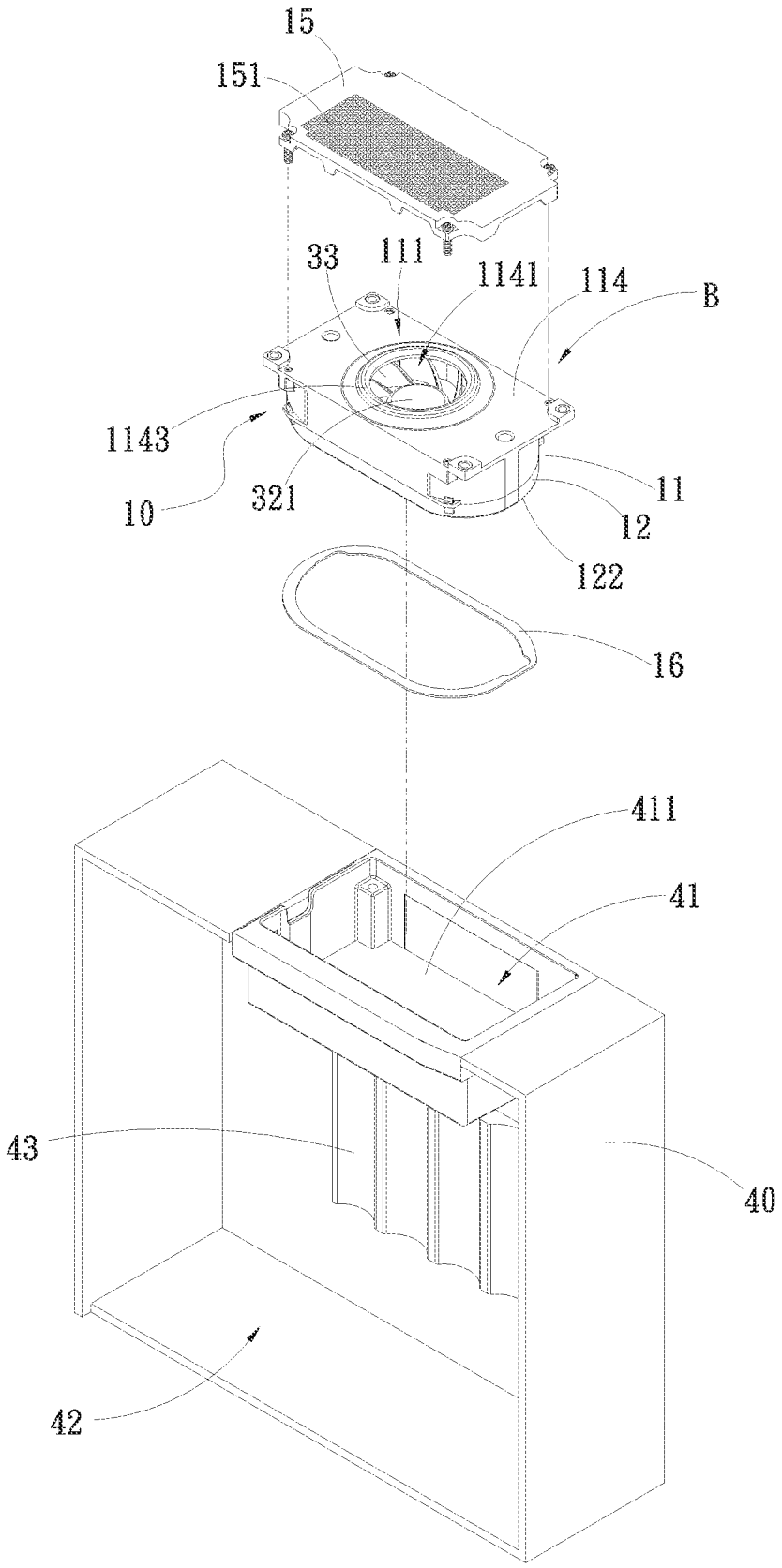
FIG. 3A is an exploded perspective view of a heat dissipation system according to an embodiment of the present invention.
Figure 3B:
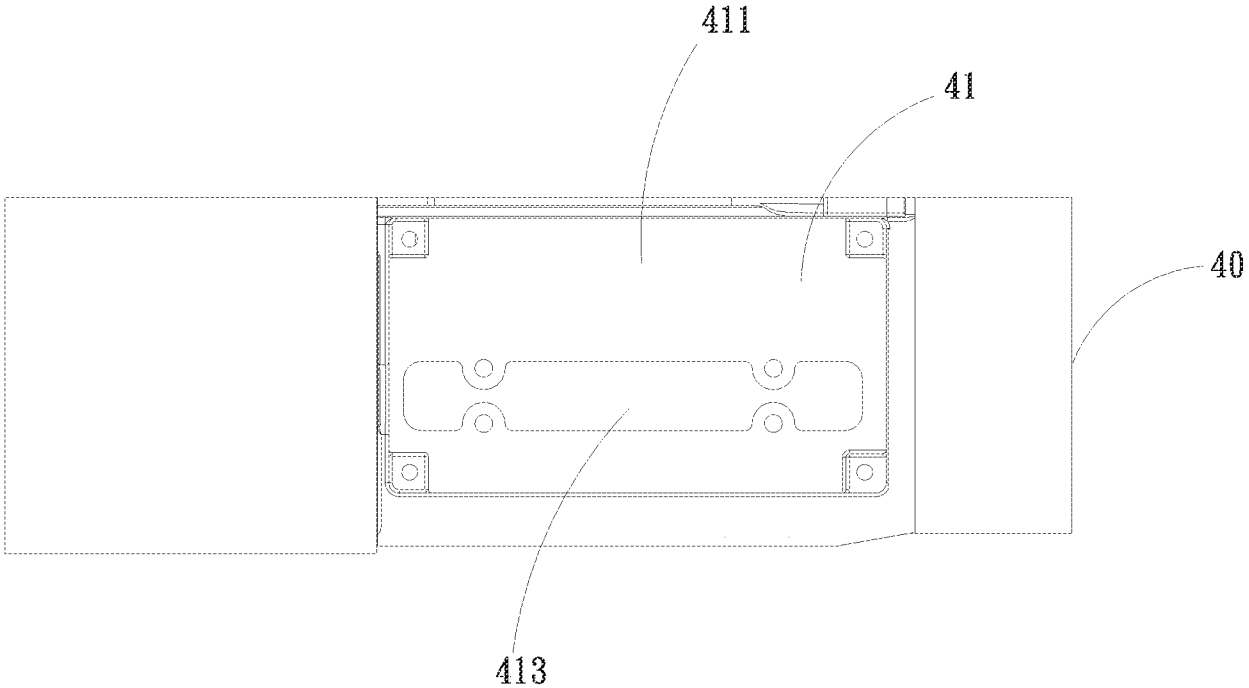
FIG. 3B is a top view of a system container of the heat dissipation system of FIG. 3A.
Figure 3C:
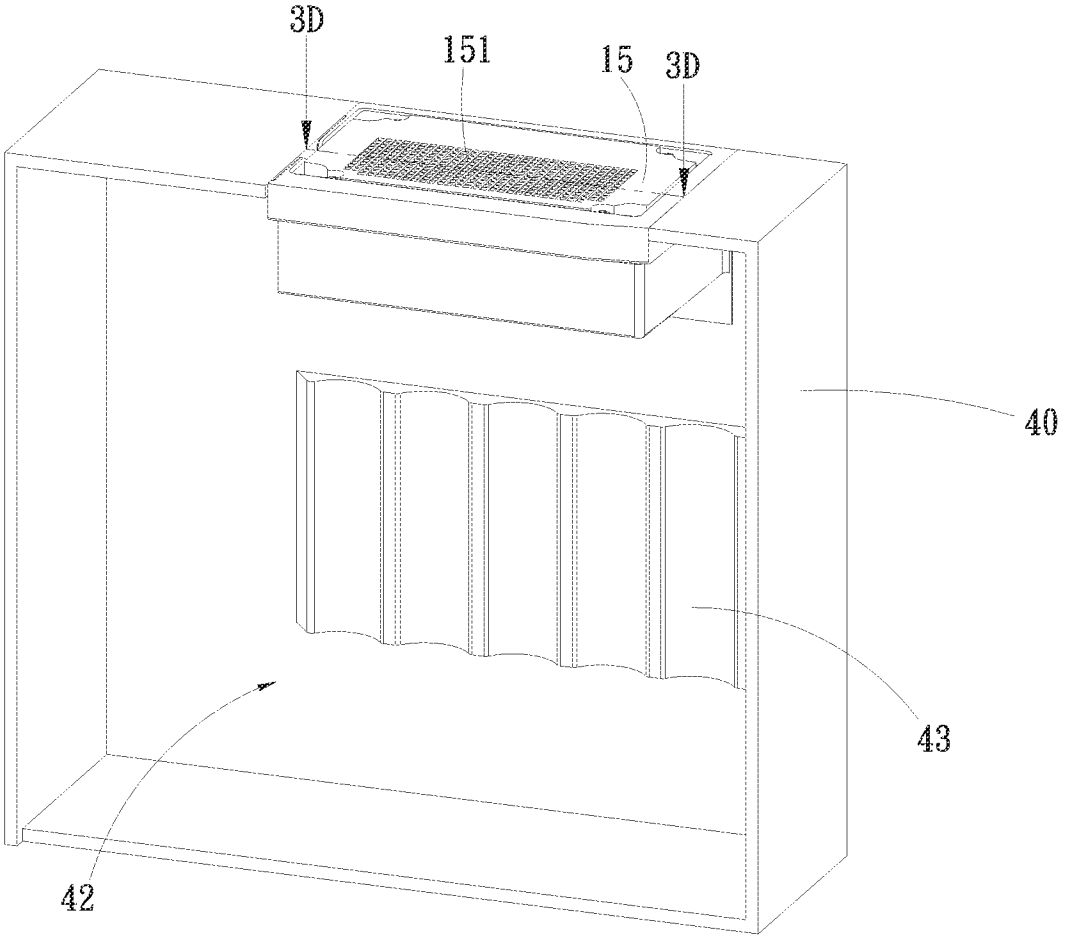
FIG. 3C is an assembled view of FIG. 3A.
Figure 3D:
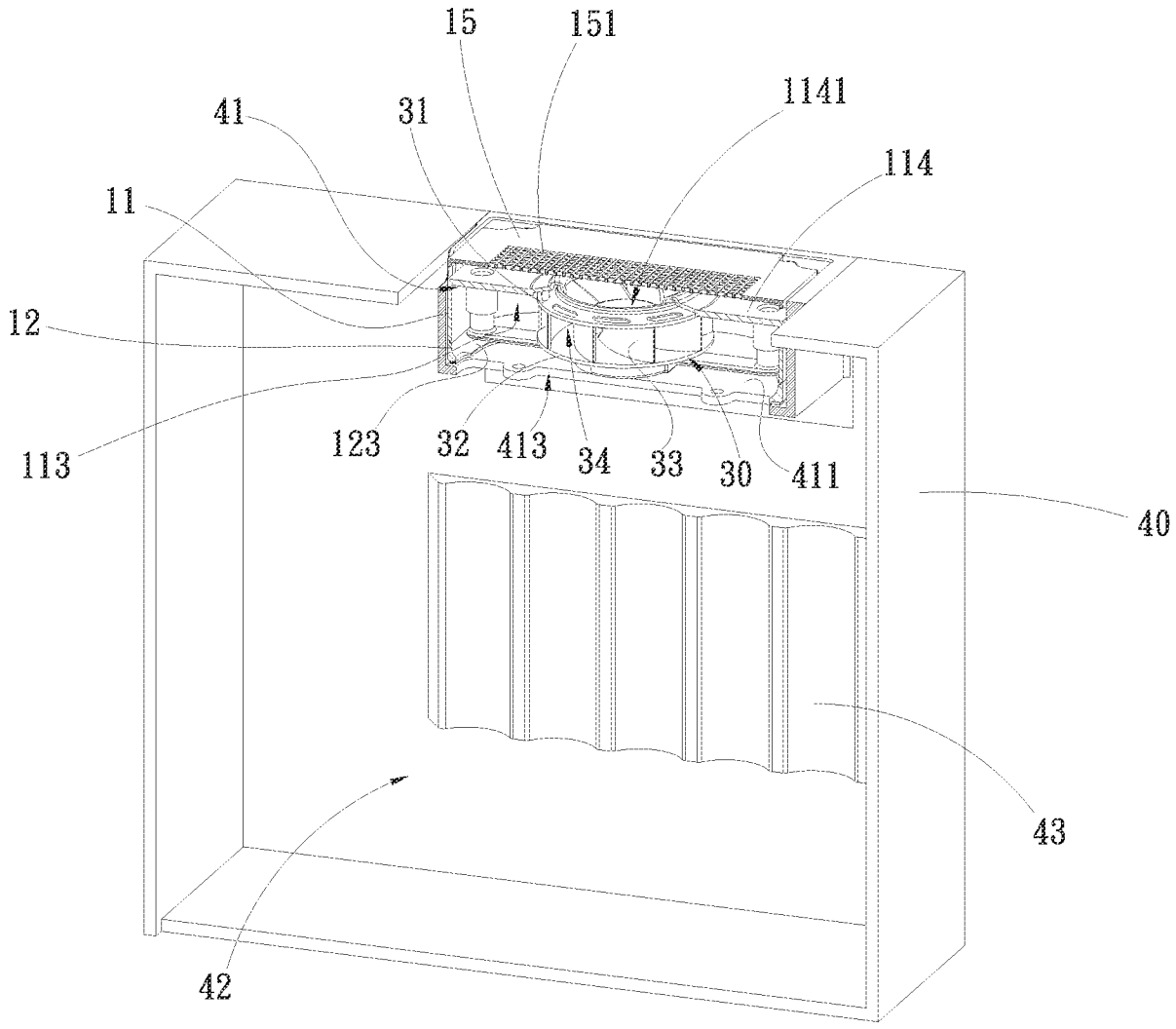
FIG. 3D is a cutaway view taken along line 3D-3D of FIG. 3C to show the blower enclosure of the centrifugal-to-axial mixed flow blower of the present invention disposed in a receiving recess of the heat dissipation system container of the present invention.

Please refer to FIGS. 3A and 3C, which are exploded and assembled perspective views, respectively, of a heat dissipation system according to an embodiment of the present invention; and to FIG. 3B, which is a top view of a system container 40 of the heat dissipation system of FIG. 3A; and to FIG. 3D, which is a cutaway view taken along line 3D-3D of FIG. 3C to show the blower enclosure 10 of the centrifugal-to-axial mixed flow blower B of the present invention disposed in a receiving recess 41 of the heat dissipation system container 40 of the present invention. Please refer to FIGS. 3A to 3D along with FIGS. 1A to 1D and FIGS. 2A to 2C. The system container 40 includes a receiving recess 41 and a container space 42. In the container space 42, there is a heat dissipation unit 43, such as a heat sink, located below the receiving recess 41. The receiving recess 41 includes a bottom 411 that separates the receiving recess 41 from the container space 42. A partial area of the bottom 411 is formed into a substantially rectangular air outlet 413, which is communicable with the container space 42.

The centrifugal-to-axial mixed flow blower B is disposed in the receiving recess 41 with the outlet side 122 of the flow guide frame 12 located adjacent to the bottom 411 of the receiving recess 41 and the frame passage 124 of the flow guide frame 12 being communicable with the blower chamber 113 and the rectangular air outlet 413. The air-in side 111 of the blower enclosure 10 is covered by an outer cover 15. The outer cover 15 includes an air venting mesh portion 151, which has a plurality of through holes distributed thereon and is located corresponding to the air inlet 1141 at the air-in side 111 of the blower enclosure 10 to provide the function of stopping foreign materials from entering into the centrifugal impeller 30 via the air inlet 1141. Further, a frame-shaped gasket 16 is optionally provided between the air-out side 122 of the flow guide frame 12 and the bottom 411 of the receiving recess 41. The frame-shaped gasket 16 is made of a flexible material, such as plastics or rubber, to provide an upgraded tightness between the blower enclosure 10 of the centrifugal-to-axial mixed flow blower B and the bottom 411 of the receiving recess 41.

Figure 3E:
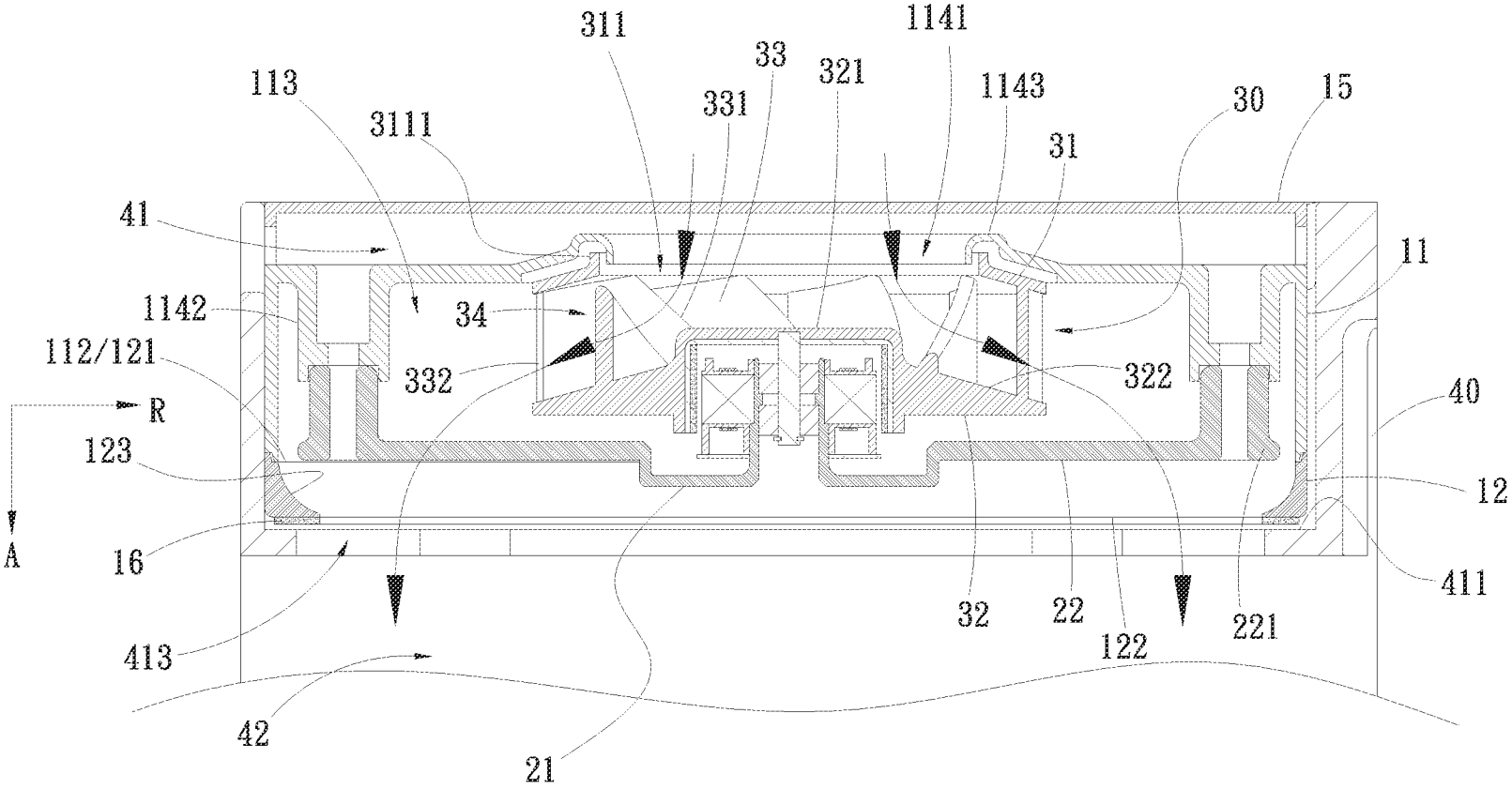
FIG. 3E shows the flow directions of air in the centrifugal-to-axial mixed flow blower and the heat dissipation system container of the present invention.
Figure 4A:
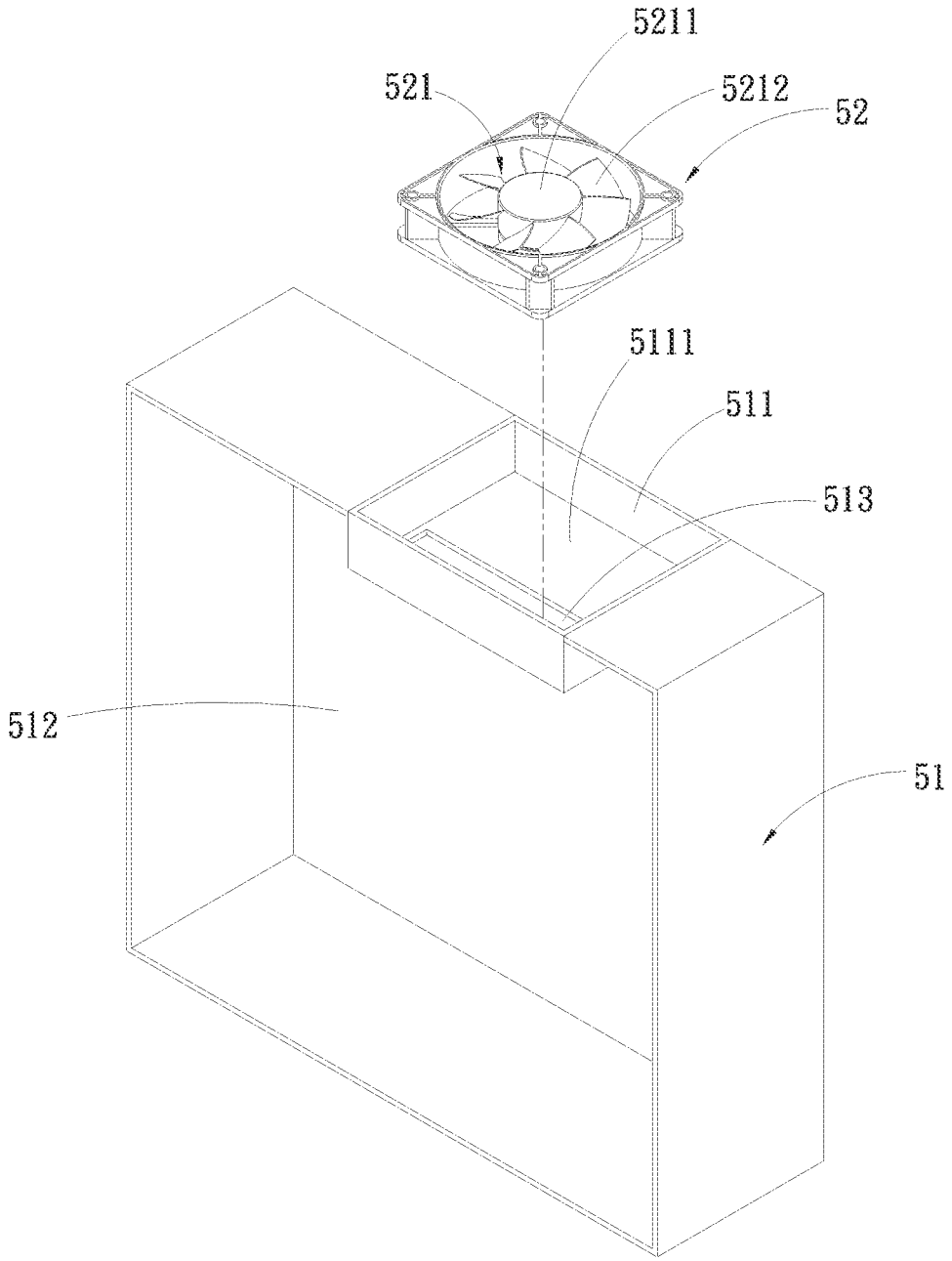
(PRIOR ART) Fig. 4A
FIGS. 4A to 4C are schematic views of a conventional axial flow blower.
Figure 4B:
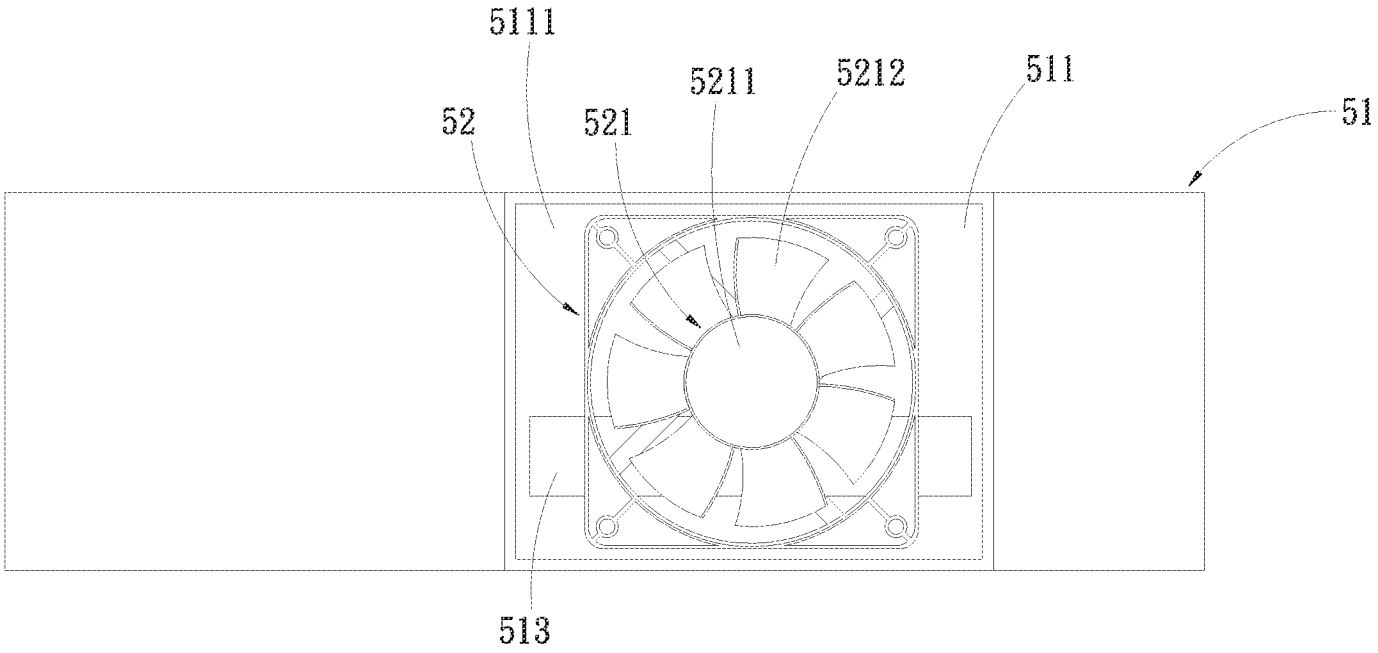
(PRIOR ART) Fig. 4B
Figure 4C:
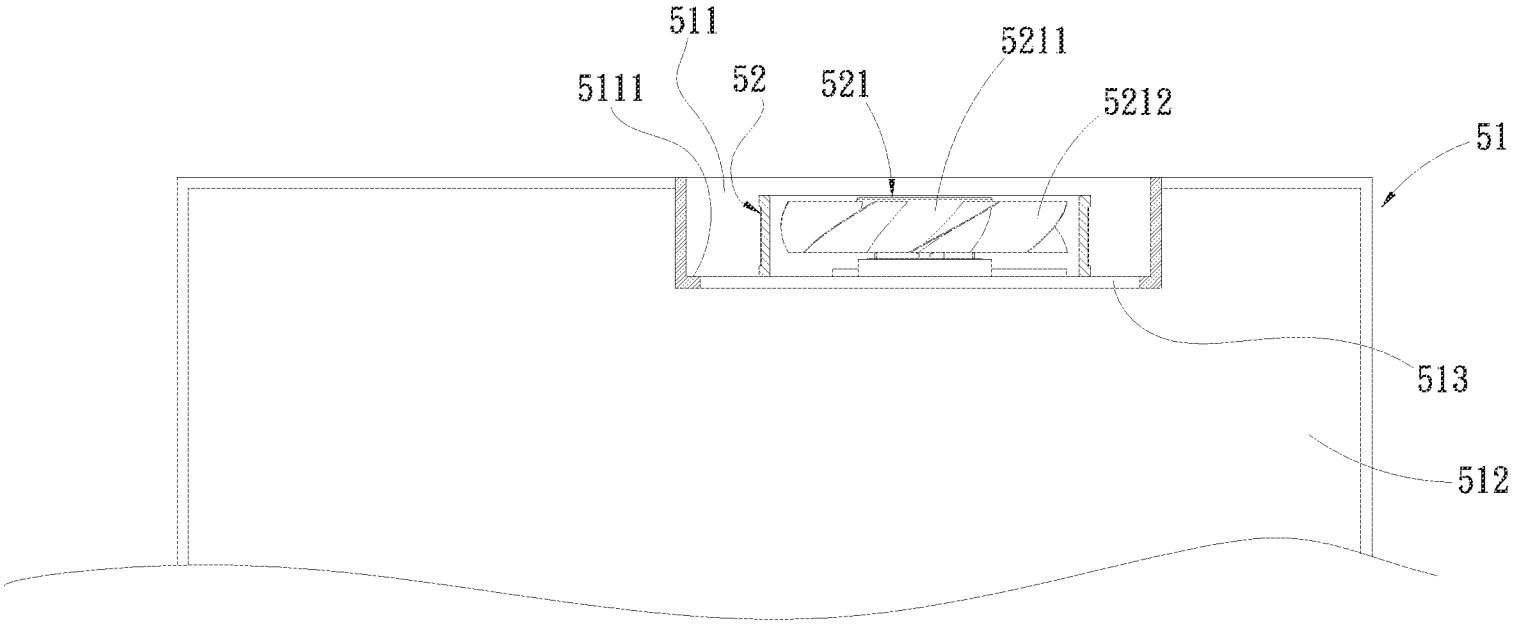
(PRIOR ART) Fig. 4C

FIG. 3E shows the flow directions of air in the centrifugal-to-axial mixed flow blower B and the heat dissipation system container 40 of the present invention. For the purpose of clearly depicting the flow directions in the heat dissipation system, some parts of the system container 40 and the outer cover 15 are omitted from the drawing. Please refer to FIG. 3E along with the previously mentioned figures. When the centrifugal impeller 30 of the centrifugal-to-axial mixed flow blower B rotates, the rotating blades 33 generate a centrifugal force, which draws an air stream (as indicated by the arrows) to flow in an axial direction A of the centrifugal impeller 30 and pass through the air venting mesh portion 151 of the outer cover 15 and the air inlet 1141 of the blower enclosure 10. Then, the air stream passes through the flow intake 311 of the top impeller frame 31 of the centrifugal impeller 30 to flow in a direction tangential to the rotating blades 33 (i.e. in a radial direction R of the centrifugal impeller 30) into the declined flow passages 34. The air stream flows along the declined flow passages 34 into the blower chamber 113, from where the air stream passes through the frame passage 124 of the flow guide frame 12. The air guide surface 123 of the flow guide frame 12 further guides the air stream toward the rectangular air outlet 413 on the bottom 411 of the receiving recess 41, and the air stream passes through the rectangular air outlet 413 into the container space 42 to carry heat away from the heat dissipation unit 43. Further, since the rotating centrifugal impeller 30 draws air into the blower chamber 113, the blower chamber 113 has an internal air pressure higher than that of the container space 42 to therefore generate a pressure difference between the blower chamber 113 and the container space 42, which is helpful for the air stream to flow axially from the air-out side 122 and the rectangular air outlet 413 on the bottom 411 of the receiving recess 41 into the container space 42. In addition, when the air stream flows into the centrifugal impeller 30 in the axial direction A and flows out the centrifugal impeller 30 in the radial direction R, the declined flow passages 34 also have the function of decreasing flow loss and noise caused by change in the flow directions.

With the above arrangements, the centrifugal-to-axial mixed flow blower B according to the present invention can realize the effect of changing a centrifugal vortical flow into an axial flow, and can be used in a limited system space to reduce noise emission and decrease flow loss.

The present invention has been described with a preferred embodiment thereof and it is understood that many changes and modifications in the described embodiment can be carried out without departing from the scope and the spirit of the invention that is intended to be limited only by the appended claims.

What is claimed is:

1. A centrifugal-to-axial mixed flow blower suitable for use with a system container having a rectangular air outlet, comprising:

a blower enclosure including a main body and a flow guide frame; the main body having an air-in side and an opposite air-out side, which together define a blower chamber between them; the flow guide frame being located at the air-out side of the main body and configured to be adjacent to the rectangular air outlet of the system container, and including a butt joining side, an outlet side, and an air guide surface; the butt joining side and the outlet side being located at two opposite sides of the flow guide frame, and the air guide surface being formed on an inner side of the flow guide frame to extend slantly from the butt joining side to the air-out side and define a frame passage on the flow guide frame; and the frame passage being communicable with the blower chamber and the rectangular air outlet;

an impeller seat including a seat portion and two cantilever portions; the two cantilever portions being extended radially outward from an outer periphery of the seat portion and respectively having a distal end formed into a corresponding connecting section for connecting to the main body of the blower enclosure, such that the impeller seat is supported in the blower chamber and the frame passage; and a centrifugal impeller being mounted on the seat portion of the impeller seat and located below an air inlet of the blower enclosure; the centrifugal impeller including a top impeller frame, a bottom impeller frame having a hub, and a plurality of blades located between the top and the bottom impeller frame; a radially outward declined flow passage being defined between any two adjacent blades of the plurality of blades, and the declined flow passage being respectively declined from an outer side of the hub toward an outer peripheral edge of the centrifugal impeller and communicable with the blower chamber; and air drawn in by the centrifugal impeller being guided by the declined flow passage to flow into the blower chamber in radially downward and outward directions and then pass through the frame passage, at where the air is guided by the air guide surface to the rectangular air outlet to flow into the system container.

2. The centrifugal-to-axial mixed flow blower as claimed in claim 1, wherein the frame passage is tapered from the butt joining side toward the outlet side to extend through a thickness direction of the flow guide frame; and wherein the butt joining side is connected to the air-out side of the main body of the blower enclosure, and the air guide surface is a slanted surface or a concave surface.

3. The centrifugal-to-axial mixed flow blower as claimed in claim 1, wherein the main body of the blower enclosure includes a top wall located at the air-in side and formed with an air inlet and two connecting sections; the air inlet being communicable with the blower chamber, and the two connecting sections being connected to the corresponding connecting sections of the impeller seat.

4. The centrifugal-to-axial mixed flow blower as claimed in claim 3, wherein the top impeller frame is located above the blades and is radially outward declined from a center toward the outer peripheral edge of the centrifugal impeller to define a flow intake, which is located corresponding to the air inlet of the blower enclosure; and wherein the bottom impeller frame includes a radially outward slanted surface, on which the blades are located; the slanted surface of the bottom impeller frame being radially outward declined from an outer side of the hub toward the outer peripheral edge of the centrifugal impeller, and the slanted surface of the bottom impeller frame and the slanted top impeller frame together defining the declined flow passages.

5. The centrifugal-to-axial mixed flow blower as claimed in claim 4, wherein an area of the top wall of the blower enclosure located around a rim of the air inlet is a bent section, which is bent toward the blower chamber to define an annular groove in the blower chamber; and the flow intake of the top impeller frame having a circumferential edge, which is upward protruded toward the top wall to form an upward protruded ring, and the upward protruded ring being correspondingly located in the annular groove of the top wall.

6. The centrifugal-to-axial mixed flow blower as claimed in claim 1, further comprising an outer cover that covers the air-in side of the blower enclosure; and the outer cover including an air venting mesh portion, which has a plurality of through holes distributed thereon and is located corresponding to the air inlet at the air-in side of the blower enclosure.

7. A heat dissipation system with centrifugal-to-axial mixed flow blower, comprising:

a system container including a receiving recess and a container space; the receiving recess including a bottom that separates the receiving recess from the container space, and a partial area of the bottom being formed into a substantially rectangular air outlet, which is communicable with the container space; and the container space having a heat dissipation unit disposed therein to be located below the receiving recess; and a centrifugal-to-axial mixed flow blower being disposed in the receiving recess and including:

a blower enclosure including a main body and a flow guide frame; the main body having an air-in side and an opposite air-out side, which together define a blower chamber between them; the flow guide frame being located at the air-out side of the main body and adjacent to the rectangular air outlet of the system container, and including a butt joining side, an outlet side, and an air guide surface; the butt joining side and the outlet side being located at two opposite sides of the flow guide frame, and the air guide surface being formed on an inner side of the flow guide frame to extend from the butt joining side to the air-out side and define a frame passage on the flow guide frame; and the frame passage being communicable with the blower chamber and the rectangular air outlet;

an impeller seat including a seat portion and two cantilever portions; the two cantilever portions being extended radially outward from an outer periphery of the seat portion and respectively having a distal end formed into a corresponding connecting section for connecting to the main body of the blower enclosure, such that the impeller seat is supported in the blower chamber and the frame passage; and a centrifugal impeller being mounted on the seat portion of the impeller seat and located below an air inlet of the blower enclosure; the centrifugal impeller including a top impeller frame, a bottom impeller frame having a hub, and a plurality of blades located between the top and the bottom impeller frame; a radially outward declined flow passage being defined between any two adjacent blades of the plurality of blades, and the declined flow passage being respectively declined from an outer side of the hub toward an outer peripheral edge of the centrifugal impeller and communicable with the blower chamber; and air drawn in by the centrifugal impeller being guided by the declined flow passage to flow into the blower chamber in radially downward and outward directions and then pass through the frame passage, at where the air is guided by the air guide surface to the rectangular air outlet to flow into the system container.

8. The heat dissipation system with centrifugal-to-axial mixed flow blower as claimed in claim 7, wherein the frame passage is tapered from the butt joining side toward the outlet side to extend through a thickness direction of the flow guide frame; and wherein the butt joining side is connected to the air-out side of the main body of the blower enclosure and located adjacent to the bottom of the receiving recess, and the air guide surface is a slanted surface or a concave surface.

9. The heat dissipation system with centrifugal-to-axial mixed flow blower as claimed in claim 7, wherein the main body of the blower enclosure includes a top wall located at the air-in side and formed with an air inlet and two connecting sections; the air inlet being communicable with the blower chamber, and the two connecting sections being connected to the corresponding connecting sections of the impeller seat.

10. The heat dissipation system with centrifugal-to-axial mixed flow blower as claimed in claim 9, wherein the top impeller frame is located above the blades and is radially outward declined from a center toward the outer peripheral edge of the centrifugal impeller to define a flow intake, which is located corresponding to the air inlet of the blower enclosure; and wherein the bottom impeller frame includes a radially outward slanted surface, on which the blades are located; the slanted surface of the bottom impeller frame being radially outward declined from an outer side of the hub toward the outer peripheral edge of the centrifugal impeller, and the slanted surface of the bottom impeller frame and the slanted top impeller frame together defining the declined flow passages.

11. The heat dissipation system with centrifugal-to-axial mixed flow blower as claimed in claim 10, wherein an area of the top wall of the blower enclosure located around a rim of the air inlet is a bent section, which is bent toward the blower chamber to define an annular groove in the blower chamber; and the flow intake of the top impeller frame having a circumferential edge, which is upward protruded toward the top wall to form an upward protruded ring, and the upward protruded ring being correspondingly located in the annular groove of the top wall.

12. The heat dissipation system with centrifugal-to-axial mixed flow blower as claimed in claim 9, further comprising an outer cover and a frame-shaped gasket; the outer cover covering the air-in side of the blower enclosure and including an air venting mesh portion, which has a plurality of through holes distributed thereon and is located corresponding to the air inlet at air-in side of the blower enclosure; and the frame-shaped gasket being provided between the flow guide frame and the bottom of the receiving recess.

* * * * *